United States Patent [19]

Collier

[11] Patent Number: 4,659,168

[45] Date of Patent: Apr. 21, 1987

[54] ELECTRICAL CONNECTOR

[75] Inventor: John C. Collier, York, Pa.

[73] Assignee: Burndy Corporation, Norwalk, Conn.

[21] Appl. No.: 647,956

[22] Filed: Sep. 6, 1984

[51] Int. Cl.[4] ..... H01R 13/502

[52] U.S. Cl. ..... 339/191 M; 339/176 M; 339/206 R; 339/258 S; 339/217 TP

[58] Field of Search ..... 339/191 R, 191 M, 191 S, 339/176 M, 258 R, 258 P, 258 F, 258 S, 217 R, 217 PS, 217 TP, 65, 66 R, 66 M, 47, 107, 206 R, 206 P, 97 R, 97 P, 98, 99 A

[56] References Cited

U.S. PATENT DOCUMENTS

| | | | |
|---|---|---|---|
| 3,184,705 | 5/1965 | Obert et al. | 339/176 M |
| 3,245,024 | 4/1966 | Evans | 339/65 |
| 3,296,576 | 1/1967 | Motten, Jr. | 339/176 M |
| 4,243,288 | 1/1981 | Lucius et al. | 339/206 R |
| 4,350,404 | 9/1982 | Clark et al. | 339/97 R |
| 4,441,778 | 4/1984 | Sampson | 339/99 R |
| 4,483,577 | 11/1984 | Novis | 339/176 M |

*Primary Examiner*—Gil Weidenfeld
*Assistant Examiner*—Thomas M. Kline
*Attorney, Agent, or Firm*—Perman & Green

[57] ABSTRACT

An electrical connector system which includes electrically conductive wires terminating in tab receptacles, electrically conductive blade contacts and an electrically insulative terminal block assembly to facilitate the joining and supporting of the wires to the blade contacts. The terminal block assembly is comprised of two portions. The first portion is a fixed block with apertures, each for receiving and supporting a blade contact in a predetermined orientation. The second portion of the terminal block is a movable block with barrels or pockets, each for receiving an electrically conductive wire, each of which wire terminates with a tab receptacle. Because of the design and construction of the portions of the terminal block assembly, the tab receptacles and their electrically conductive wires may be conveniently and reliably mounted onto the blade contacts in the fixed portion of the terminal block assembly and securely retained there.

9 Claims, 5 Drawing Figures

ELECTRICAL CONNECTOR

BACKGROUND OF THE INVENTION

This invention relates generally to a system for connecting conductive wires to blade contacts and, more specifically, to a terminal block assembly for joining and supporting electrically conductive wires with tab receptacles in contact with blade contacts to thereby permit the flow of electrical current therebetween.

In many electrical machines, such as appliances, a plurality of discrete electrical motors, timers, assemblies, components and the like must receive their powering current from discrete and predetermined electrical wires. To effect this objective, the various portions of the machines are provided with contacts in the form of blades clustered at a single predetermined location. In this manner, the appropriate wires may be brought together to such location for the necessary electrical coupling at the time of initial installation or during maintenance or repair.

Many techniques have been attempted for the coupling of such wires to such blade contacts, whether singly or as a group. Such prior art techniques include soldering, screws, clips and so forth. However, all such prior art techniques suffer from one shortcoming or another, as for example, high cost, time consuming installation, requirement for skilled labor, susceptability of the contacts to separate through time or vibrating and various other problems.

SUMMARY OF THE INVENTION

Briefly stated, and in accordance with the present invention, there is herein disclosed an improved electrical connector system which includes electrically conductive wires terminating in tab receptacles, electrically conductive blade contacts and an electrically insulative terminal block assembly to facilitate the joining and supporting of the wires to the blade contacts. The terminal block assembly is comprised of two portions. The first body portion is a block with apertures, each for receiving and supporting a blade contact in a predetermined orientation. The body portion block can be fixed in a host structure. The second portion of the terminal block is a movable block with barrels or pockets, each for receiving an electrically conductive wire and each of which wire terminates with a tab receptacle. Because of the design and construction of the portions of the terminal block assembly, the tab receptacles and their electrically conductive wires may be conveniently and reliably mounted onto the blade contacts in the fixed portion of the terminal block assembly and securely retained therein through the application of minimum skill and cost.

The present invention allows for the coupling of electrical components with reduced installation force and with the self alignment of the components thereby permitting such coupling in blind situations for rendering the coupling suitable for automated assembly. Once installed, the assembly will provide mechanical and electrical stability, including torsional stability, tending to resist separation of the coupled components.

In addition to aiding in the joining and supporting the coupled electrical components, the terminal block assembly of the present invention will encase such components within an electrically insulating housing. Such encasement is desirable since it eliminates the presence of exposed conductive elements where a shock hazard might be present. Moreover, such a housing can serve the purpose of further protecting the terminals being joined from being dislodged or damaged.

DETAILED DESCRIPTION OF THE INVENTION

Figure 1:
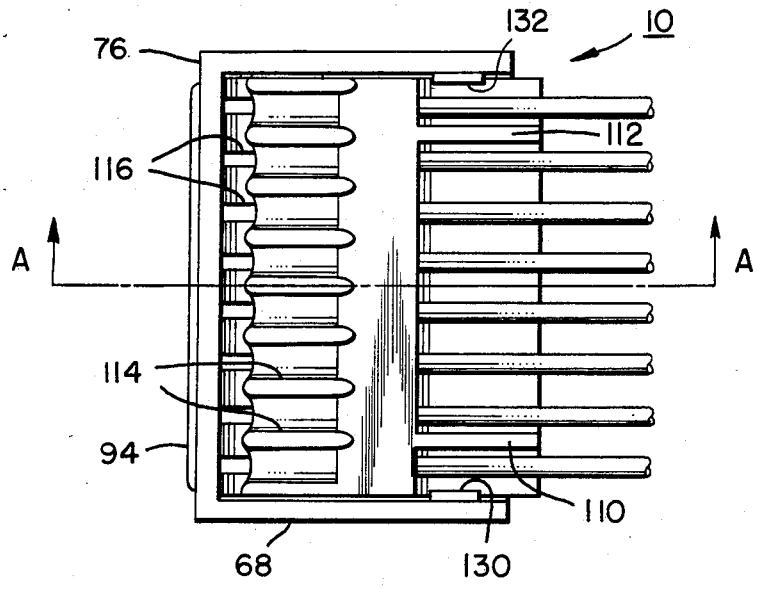
FIG. 1 is a top plan view of the electrical connector system designed and constructed in accordance with the principals of the present invention.

As can be seen in the drawings, the electrical connector system 10 includes one, or, preferably, a plurality, of discrete electrically conductive wires 12 and electrically conductive contacts such as blades 14 adapted to be joined to the wires in a secure manner both mechanically and electrically. Each wire has secured thereto at its end a tab receptacle 16 to effect this joining. For this purpose, a terminal block assembly 18 is provided and constructed of a first body portion 20, which is preferably fixed in the host appliance, for separately receiving and holding the individual blade contacts. The terminal block assembly also includes a second movable portion 22 for separately receiving and holding the individual electrically conductive wires and tab receptacles.

Each of the electrically conductive wires is provided with a free or outboard end 24 stripped for a portion 26 of its extent from its surrounding electrically insulating sleeve 28. This will expose its internal electrically conductive strands 30. Any suitable connector can be joined to the conductor of the wire. For instance, a tab receptacle can be provided therearound as shown with a first bight 32 adapted to be crimped and secured about the end of the insulating sleeve of the wire.

On each tab receptacle there is also a second bight 34 adapted to be crimped and secured onto the exposed electrically conductive portion of the wire. Each bight helps to mechanically secure the tab receptacle and its associated wire. The second bight also creates an electrical coupling of the tab receptacle to its associated wire.

Each tab receptacle extends outboardly of the bights and terminates with a slot 38, each slot extending in an axial direction with regard to the wires. Leaves 40, 42, 44 and 46 are thus formed on each side of the slot. Each leaf is then axially folded with the longitudinal free edge 50, 52, 54 and 56 located towards the slot therebetween. It is preferred that these folded leaves be mounted with their edges extending slightly upwardly toward the free end of its associated blade contact for ensuring the retention of the tab receptacles on the blade contacts.

Each electrically conductive wire is thus adapted, via its tab receptacle, to be electrically and mechanically secured to a predetermined upwardly extending blade contact. Each blade contact 14 can be of an essentially conventional design with tapered free end 60 to assist in positioning. However, each is preferably provided with a shoulder 62 and a spring biased flap 64 to assist in the positioning and retention of the tab receptacle and wire in a predetermined fixed orientation.

The features of the leaves are such that a very high interface contact pressure is obtained along the lower edges 54 and 56 of the leaves closer the base of the blade contact. Interface pressure of a lower level is obtained along the upper edges 50 and 52 of the leaves closer to the free end 60 of the blade contact. In addition to carrying electrical current, the leaves also provide torsional stablility to the system. It should also be noted that the molding of the terminal block portions wwith their outboard ends formed as an interlocking hinge will prevent any excessive mechanical forces being applied to the contacting electrical components.

Molded of an electrically insulating material, in two separate portions, is the terminal block assembly 18. The first portion 20 is adapted to be fixedly positioned in the host system and to receive one, but preferably, the plurality of blade contacts. The second portion 22 of the assembly is movable with respect to the first portion of the terminal block assembly and the blade contacts supported therein. The second portion is adapted to receive one, preferably the plurality, of electrically conductive wires and associated tab receptacles in a predetermined orientation for mounting the electrically conductive wires appropriately with respect to the first portion of the terminal block assembly and the blade contacts.

The body or fixed portion of the terminal block assembly includes edge walls 68 and 70 coupled together through a first or primary lower support bar 72 and a secondary lower support bar 74 as well as an upper support bar 76. As used herein, the term upper and lower are intended for descriptive reference only and are made with respect to a central plane extending through the lower surface of the movable portion of the terminal block assembly and the upper surface of the primary and secondary lower support bars which are in facing contact during operation. It should be understood, however, that the terminal block assembly need not be utilized solely in a horizontal plane but may extend in the vertial plane or any angular plane with respect thereto.

Formed in the first portion of the terminal block assembly is one, or preferably a plurality, of apertures 80 extending through the primary lower support bar 72. The apertures are of such size and orientation that each may conveniently and separately receive a single blade contact 14 with the free end portion of the blade contact extending a sufficient distance thereabove for being matingly engaged by a tab receptale 16 of an electrically conductive wire 12.

The lower portion of each primary lower support bar aperture includes a chamfer 82 for the ease of locating the external free end of a blade contact into an aperture during the assembly operation. Each of the apertures in the primary lower support bar is also provided with a recess 84 extending upwardly a predetermined distance for receiving the shoulder 62 of the blade contact 14. In this manner, the blade contact can be precluded from extending too great a distance through the primary lower support bar.

As mentioned hereinabove, each of the blade contacts is preferably cut in the shape of an "L" in two directions to create a flap 64. These flaps are then deformed in a springed manner whereby each flap may exert a holding force between the blade contact and the side wall of its associated aperture. Because of this, each blade contact can more conveniently resist forces tending to move a blade contact outwardly from its fixed portion in an aperture of the terminal block assembly.

A second lower support bar 74, like the first bar 72, also extends from one end wall 68 to the other 70 of the first potion 20 of the terminal block assembly 18. This secondary lower support bar 74 is parallel with the first and it is located adjacent the inboard end 88 of the assembly. The purpose of this bar is to strengthen the terminal block assembly and to provide support for the second or movable portion 22 of the terminal block assembly during operation. A third or upper support bar 76 also extends parallel with the primary and secondary lower support bars and also connects the end plates together.

A sufficient distance is provided between the upper and the primary lower support bars to create an opening 92 whereby a leading edge projection 94 of the movable portion of the terminal block assembly may be located therebetween during assembly and operation. This upper support bar is located even further outboard of the assembly than is the primary support bar.

The second portion 22 of the terminal block assembly is the movable portion. It is adapted to receive and support the conductive wires with their tab receptacles. This portion of the terminal block assembly includes a first plate 96 and a second plate 98 which are joined together as part of the same molding, each of which extends laterally from end wall 68 to end wall 70 of the fixed portion of the terminal block assembly. The first plate 96 is provided with apertures 102 in spaced orientation to align with the apertures 80 of the lower portion of the terminal block assembly and receive blade connectors. The first plate 96 and second plate 98 of the movable portion are oriented one with respect to one another to create tunnels or barrels 104 therebetween corresponding in number and location to the aforementioned blade contacts and apertures of both portions of the terminal block assembly. Each of the barrels has an enlarged inboard bore 106 and a reduced outboard bore 108. The outboard bore is adapted to receive the smaller portion of the tab receptacles with its leaves while the inboard bore is adapted to receive the larger crimped bights.

Coupling of the first plate to the second plate is effected through molded ribs 110 and 112 at the inboard end and, at the outboard end, by spaced barrel walls 114 which separate the barrels for individually receiving the insulating wire conductors and their associated tab receptacles. Undercut troughs 116 are provided on the upper surface of the first plate during the molding of the second plate. These undercut troughs are essentially parallel with the incoming electrically conductive wires.

The outboard end 120 of the second plate 98 is chamfered at an angle of approximately 45 degrees to create holes 122 in the second plate exposing the barrels. The particular angle has been selected so that the projection 94 on the outboard end of the first plate 96 may, during installation, be located in the opening 92 between the primary lower support bar and the upper support bar. The angled outboard end 120 of the second plate 98 effects a predetermined contact with the inboard face 124 of the upper support bar at the initiation of the assembly operation.

Figure 2:
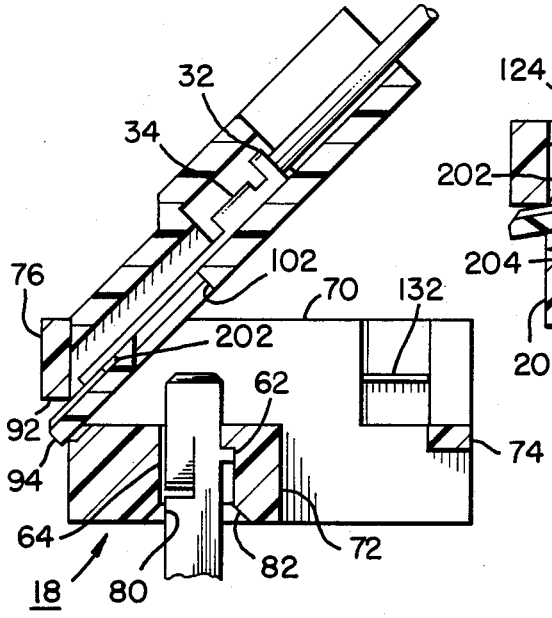
FIGS. 2, 3, and 4 are cross-sectional views of the electrical connector system as shown in FIG. 1 taken along section line A—A of FIG. 1 and showing the two portions of the terminal block assembly in various stages of assembly.
Figure 3:
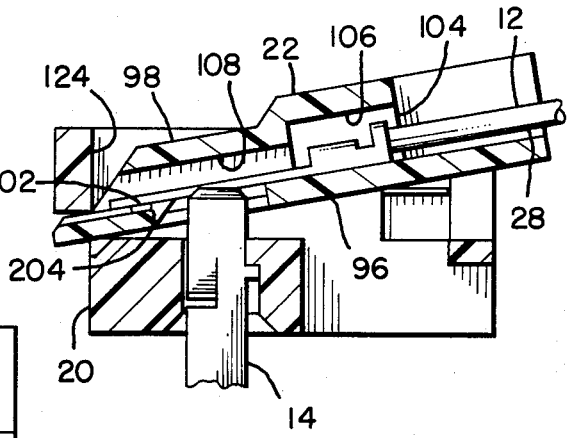

With the electrically conductive wires and tab receptacles terminals in place within the barrels, the movable portion of the terminal block assembly may then be rotated clockwise from its orientation as shown in FIG. 2. The movable portion rotates through the orientation as shown in FIG. 3 and is stopped in the FIG. 4 orientation to thereby frictionally join and maintain the electrically conductive wires and their related tab receptacles onto the blade contacts. This downward rotation continues until the lower face of the first plate 96 rests on the upper surface of the primary and secondary lower support bars to complete the installation process.

Figure 4:
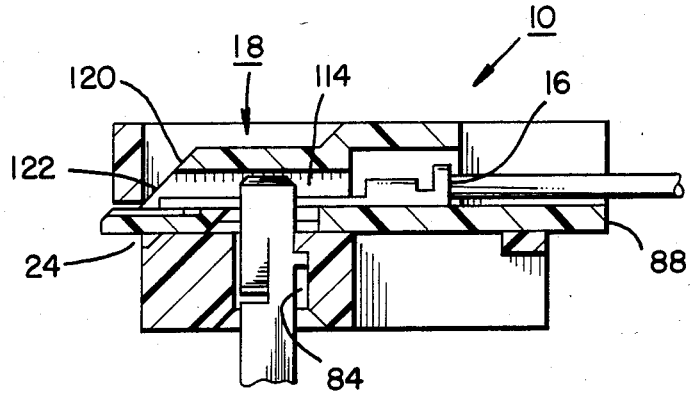
Figure 5:
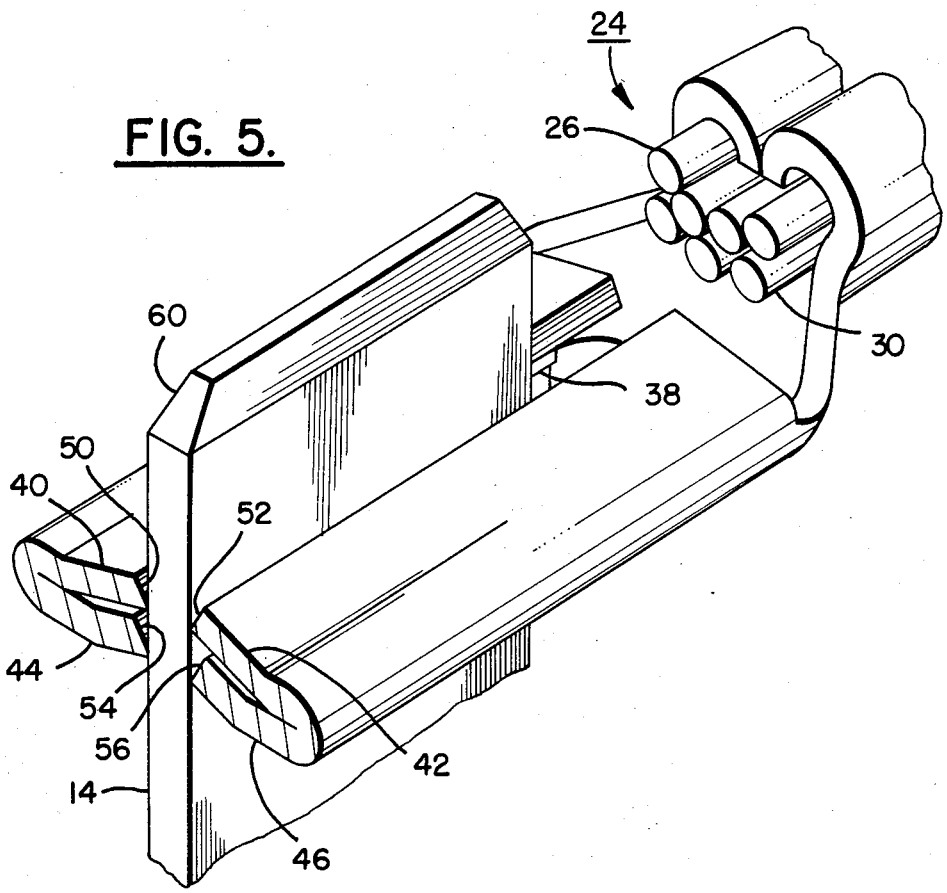
FIG. 5 is an illustration of part of the electrical connector system as shown in FIGS. 1 through 4 illustrating an electrically conductive wire, tab receptacle and blade contact in an isometric view.

As can be seen from the FIG. 4, the assembly provides for a low profile for the insulating conductive wires with no need for bending the wires which might otherwise result in undue mechanical or electrical stresses within the wires.

Because of the design of the components of the terminal block assembly, a self-aligning, mating location of the terminal block portions is effected prior to the rotary closing motion. This will facilitate the easy insertion by an operator even in blind mating situations. This configuration of parts also provides suitability for automatic assembly if desired. Further, because of the hinge motion during the mating operation, the forces required to effect the coupling of the terminal to the holder is held at a reduced and comfortable level.

Since only the tip of the first plate 96 is inserted into the opening between the primary lower support and the upper support bar, only a short distance of insertion of the tab is required. This minimizes the hinging motion required and also minimizes the effort necessary to close a terminal block assembly to an operating condition.

In order to insure that the electrically conductive wires and tab receptacles are properly oriented within each barrel of the movable portion of the terminal block assembly, a security means can be provided. Plates 96 and 98 partially separate the barrels into the outboard reducing bore 108 and inboard enlarged bore 106. In the embodiment shown, each tab receptacle 16 may have means for locking or securing itself to the movable second portion 22 of the terminal block assembly. For instance, tab receptacle 16 may be made with an offset portion 202 which, when the receptacle is fully inserted into movable portion 22, drops into cavity or slot 204 in first plate 96 thereby making the receptacle secure from inadvertantly being pulled off or otherwise removed from the movable portion. The locking means can be any suitable shape and type such as spring biased flap or leaf 202 made of the receptacle material and offset from the receptacle in the direction of the cavity as shown in FIGS. 2–4. The flap, once it enters cavity 204, abuts the wall of the cavity and holds the receptacle in place. With the cooperating elements of flap 202 and cavity 204, an operator can insert the terminals to the appropriate distance to have the flap drop into the cavity to secure the tab receptacle in the movable portion and to present the appropriate amount of tab receptacle for receiving by the blade terminals.

Also located on the interior surfaces of both end plates are position locking tabs 130 and 132 adapted to hold the upper surface of the first plate 96 at its edges in an appropriate orientation with regard to the fixed portion of the terminal block assembly. The first plate 96 may, if desired, be provided with chamfered edges to slidingly contact and outwardly spring the tabs during the coupling operation. The end plates will then spring urge the tabs toward each other and the second portion of the terminal block assembly to effect the locking action when the first plate is properly seated with respect to the locking tabs and the lower portion of the terminal assembly.

The "Chinese Finger" action of the leaves of the tab receptacle on the blade contact creates extraction or separation forces that are higher than the force necessary to couple these elements. This feature, combined with the fact that the closing force is applied via the tabs on the fixed portion of the terminal block assembly, is such that any force created by the wires in a direction that would tend to open its electrical coupling with its blade contact will be transmitted to the movable portion of the terminal block assembly closer to the focal point, generating a proportionately lower turning moment. The net result could preclude the necessity of providing the positive locking tabs in the closed position.

It should be understood that the foregoing description is only illustrative of the primary embodiment of the invention. Various alternatives and modifications of the structural and functional features of the receptacle connector can be devised by those skilled in the art without departing from the invention. Accordingly, the present invention is intended to embrace all such alternatives, modifications and variances which fall within the spirit and scope of appended claims.

What is claimed is:

1. An electrical connector system comprising;

a plurality of electrically conductive wires;

a tab receptacle coupled to the end of each of said wires;

a plurality of blade contacts, each adapted to be received by a tab receptacle of a predetermined electrically conductive wire; and a terminal block assembly, said terminal block assembly including a fixed body portion having a first lower support bar with a first plurality of apertures, an upper support bar and an opening between said first lower support bar and said upper support bar, each of said first plurality of apertures adapted to receive a blade contact, said terminal block assembly also including a movable body portion having a first plate including a second plurality of apertures aligned for the receipt of said blade contacts therethrough, a second plate, and walls coupling said first and second plates, said walls being spaced one from another to form barrels therebetween, said movable body portion including said first and second plates movable relative to said fixed body portion, each of said barrels adapted to receive at least one of said plurality of electrically conductive wires and tab receptacles, said movable body portion having a portion to be matingly received within said opening of said fixed body portion with said blade contacts and tab receptacles being substantially perpendicular after mating in mechanical and electrical contact.

2. The electrical connector system as set forth in claim 1 wherein said opening is of sufficient size to matingly receive an outboard edge of said movable body portion.

3. The electrical connector system as set forth in claim 1 wherein each of said tab receptacles is provided with bight means for coupling with a wire and wherein each of said tab receptacles is also provided with a slot with leaves on the opposite sides thereof for receiving a blade contact, said leaves being angled whereby greater forces are required to separate the tab receptacle from the blade contact than is required to couple them.

4. The electrical connector system as set forth in claim 1 wherein each aperture of said first lower support bar is provided with a recess and each of said blade contacts is provided with a shoulder positioned in said recess to limit the distance said blade contact extends therethrough.

5. The electrical connector system as set forth in claim 1 wherein each of said blade contacts is provided with a spring biased flap for securing said blade contacts within said first plurality of lower support bar apertures.

6. The electrical connector system as set forth in claim 1 wherein said tab receptacle and terminal block assembly have cooperating elements by which said tab receptacle is secured into said terminal block assembly.

7. A terminal block assembly comprising a fixed body portion and a movable portion relative to said fixed body portion, said fixed body portion being provided with a first lower support bar having a first plurality of apertures each of which is adapted to receive first contact means therethrough, said fixed body portion also being provided with an opening to receive said movable portion, said movable portion being provided with a first plate movable relative to said fixed body portion having a second plurality of apertures being aligned for receipt of said first contact means and a second plate with walls coupling said first and second plates to form a barrel means therebetween, said barrel means adapted to receive second contact means, said movable portion being provided with projection means adapted to be located within said opening of said fixed body portion, said barrel means and said apertures being substantially perpendicularly aligned after mating whereby the mating of the fixed body portion to the movable portion will align and couple the first and second contact means.

8. The terminal block assembly as set forth in claim 7 wherein said fixed body portion includes an upper support bar creating an opening between said upper support bar and said first lower support bar, said opening being of sufficient size to matingly receive an outboard edge of said movable portion.

9. The terminal block assembly as set forth in claim 8 wherein said outboard edge of said movable portion is angled to abut with an inboard face of said upper support bar to facilitate the joining of said movable portion to said fixed body portion.

* * * * *